US007591311B2

(12) United States Patent
Minnich et al.

(10) Patent No.: US 7,591,311 B2
(45) Date of Patent: Sep. 22, 2009

(54) PROCESS FOR RECOVERING HEAVY OIL

(75) Inventors: Keith R Minnich, Pewaukee, WI (US); Mark C. Nicholson, Pewaukee, WI (US)

(73) Assignee: HPD, LLC, Plainfield, IL (US)

( * ) Notice: Subject to any disclaimer, the term of this patent is extended or adjusted under 35 U.S.C. 154(b) by 0 days.

(21) Appl. No.: 12/029,092

(22) Filed: Feb. 11, 2008

(65) Prior Publication Data

US 2008/0190607 A1 Aug. 14, 2008

Related U.S. Application Data

(60) Provisional application No. 60/888,977, filed on Feb. 9, 2007.

(51) Int. Cl.
*E21B 43/24* (2006.01)

(52) U.S. Cl. ..... 166/272.3; 166/75.12; 166/267; 166/303; 166/371

(58) Field of Classification Search ..... None
See application file for complete search history.

(56) References Cited

U.S. PATENT DOCUMENTS 5,925,255 A 7/1999 Mukhopadhyay
6,733,636 B1 5/2004 Heins
7,077,201 B2 7/2006 Heins
7,150,320 B2 12/2006 Heins
2005/0279500 A1 12/2005 Heins
2007/0051513 A1* 3/2007 Heins ..... 166/265

FOREIGN PATENT DOCUMENTS

CA 2307819 4/2005

* cited by examiner

*Primary Examiner*—Zakiya W. Bates
(74) *Attorney, Agent, or Firm*—Coats & Bennett, P.L.L.C.

(57) ABSTRACT

A method for recovering oil includes recovering an oil-water mixture from a well and separating oil from the oil-water mixture to produce an oil product and produced water. The produced water is directed to an evaporator which produces steam that is condensed to form a distillate. Thereafter the distillate is directed to a steam generator and is heated to form steam and water. At least a portion of the water is recirculated through the steam generator. Another portion of the water is mixed with the steam to form a steam-water mixture that is injected into an injection well.

16 Claims, 6 Drawing Sheets

PROCESS FOR RECOVERING HEAVY OIL

CROSS-REFERENCE TO RELATED APPLICATION

This application claims priority under 35 U.S.C. § 119(e) from the following U.S. provisional application: Application Ser. No. 60/888,977 filed on Feb. 9, 2007. That application is incorporated in its entirety by reference herein.

BACKGROUND

Conventional, oil recovery involves drilling a well and pumping a mixture of oil and water from the well. Oil is separated from the water and the water is usually injected into a sub-surface formation. Conventional recovery works well for low viscosity oil. However, conventional oil recovery processes do not work well for higher viscosity, or heavy, oil.

Enhanced Oil Recovery (EOR) processes employ thermal methods to improve the recovery of heavy oils from sub-surface reservoirs. The injection of steam into heavy oil bearing formations is a widely practiced EOR method. Typically, several tonnes of steam are required for each tonne of oil recovered. Steam heats the oil in the reservoir, which reduces the viscosity of the oil and allows the oil to flow to a collection well. After the steam fully condenses and mixes with the oil the condensed steam is classified as produced water. The mixture of oil and produced water that flows to the collection well is pumped to the surface. Oil is separated from the water by conventional processes employed in conventional oil recovery operations.

For economic and environmental reasons it is desirable to recycle the water used in steam injection EOR. This is accomplished by treating the produced water and directing the treated feedwater to a steam generator or boiler. The complete water cycle includes the steps of:

- injecting the steam into an oil bearing formation,
- condensing the steam to heat the oil whereupon the condensed steam mixes with the oil to become produced water,
- collecting the oil and produced water in a well,
- pumping the mixture of oil and produced water to the surface,
- separating the oil from the produced water,
- treating the produced water so that it becomes the steam generator or boiler feedwater, and
- converting the feedwater into steam, which has a quality of approximately 70% to nearly 100%, for injecting into the oil bearing formation.

Several treatment processes are used for converting produced water into steam generator or boiler feedwater. These processes typically remove constituents which form harmful deposits in the boiler or steam generator. These water treatment processes used in steam injection EOR typically do not remove all dissolved solids, such as sodium and chloride.

The type of steam generator that is most often used for steam injection EOR is a special type called the Once-Through-Steam-Generator (OTSG). The OTSG converts approximately 80% of the feedwater to steam. The remaining 20% of feedwater is discharged from the OTSG as a liquid mixed with the steam. This steam and water mixture is defined as 80% quality steam. While some OTSG designs can produce 85% or 90% quality steam and other designs are limited to 70% or 75% quality steam, it is a common feature for OTSGs used in EOR that some amount of water is required in the discharged steam to keep the entire steam generator heat transfer surface wetted. The OTSG which produces approximately 80% quality steam is appropriate for some steam injection EOR operations. First, unlike conventional industrial boilers, an OTSG can accept feedwater that has dissolved solids that are not removed by the water treatment process. These solids are flushed from the steam generator as residual dissolved solids in the 20% of feedwater that is not converted to steam. Secondly, 100% of the output from the OTSG is injected because it is acceptable to inject 80% quality steam into some heavy oil bearing formations.

For some EOR operations an OTSG that generates 80% quality steam is adequate. However, there are cases where generating 80% quality steam is not adequate. This is especially true for oil bearing formations where oil is bound or contained in sand deposits such as widely found in the Alberta, Canada region. In such cases, oil is typically recovered using what is referred to as a steam assisted gravity discharge (SAGD) process, and in SAGD processes, steam quality on the order of 70%-80% will not work to efficiently and effectively recover oil.

The SAGD process was developed for in-situ recovery of oil from oil sands deposits located in the Province of Alberta, Canada. The SAGD process requires a high quality steam. Indeed, in the past, most SAGD process have required near 100% quality steam. The requirement for such a high quality steam presents a challenge because it is not possible to produce high quality steam using a conventional OTSG. On the other hand, using a conventional industrial boiler has its drawbacks. While high quality steam can be achieved, the feedwater to such industrial boilers must be extensively treated.

The high quality steam required for the SAGD process is usually produced by directing 80% quality steam from the OTSG into a steam separator. The steam separator produces two streams. The first stream is a high quality steam, typically near 100% quality steam. The second stream is a liquid blowdown stream that contains the residual dissolved solids that were in the feedwater to the steam generator. This liquid blowdown stream is typically depressurized through pressure reducing stations, which might or might not include heat recovery, and then recycled to the water treatment process.

The liquid blowdown stream from the steam separator of a typical SAGD operation, which uses physical/chemical treatment and ion exchange for treating the produced water, is at least 20% of the feedwater flow and has been reported as high as 30%. The equipment required to process this blowdown stream represents a capital expense that provides no value in the oil recovery process. The heat recovery techniques which are employed to minimize the heat lost from the liquid blowdown stream from the separator do not recover 100% of the heat, and the liquid blowdown stream represents an operating cost that has no value in the oil recovery process. Another capital cost impact is that the water treatment system capacity must be increased by at least 25% to accommodate for the liquid blowdown stream from the steam separator.

An alternative for treatment of produced water that removes many of the dissolved solids is evaporation of the produced water. Distillate from the evaporator becomes the feedwater for a packaged boiler, for example. This process has the advantage of producing a higher quality feedwater for steam generation. However, even high quality distillate has some dissolved solids. These solids tend to accumulate in a packaged boiler. All packaged boilers require a blowdown stream to purge the dissolved solids that are present in the distillate. For a typical evaporator distillate of 2 ppm TDS comprised of 0.04 ppm hardness as $CaCO_3$ and a packaged boiler operating at 1200 psig, the solubility limits of $Ca(OH)_2$ and $CaCO_3$ requires a blowdown of approximately 5%. Typically this blowdown stream is recycled to the water treatment system.

An OTSG can be utilized in a heavy oil recovery process that utilizes evaporation to treat feedwater for steam generation. If an OTSG is used in such a process, the steam quality will still be substantially less than 100% and a high pressure liquid blowdown stream is still required. This is due to the fact that conventional OTSGs require water to wet the heat transfer surfaces. Therefore, when an OTSG is utilized with evaporator distillate as feedwater, a steam separator is required and that gives rise to increased capital cost and operating cost.

Therefore, with either an OTSG or a boiler, a pressurized blowdown waste stream is created. In order to accommodate the blowdown waste stream, equipment is required to reduce the pressure of the blowdown waste stream, recover heat from the blowdown stream, and to channel the blowdown waste stream. This increases both capital and operating costs. In addition, these blowdown waste streams carry substantial energy that is lost. Finally, in many applications, these blowdown waste streams would comprise 5% to 20% of the feedwater to the OTSG or boiler, which is recycled for treatment. This effectively reduces the capacity of the treatment facility by 5% to 20%, which of course means that to compensate for treating these blowdown waste streams, the capacity of the treatment facility must be increased by 5% to 25%. This results in additional capital outlays and ongoing operating costs.

SUMMARY OF THE INVENTION

The present invention relates to a SAGD oil recovery system and process that generates and utilizes less than 100% quality steam to recover heavy oil from oil bearing formations. In this process, steam having a quality of approximately 98% is injected into the oil bearing formation, sometimes referred to as an injection well, and the heat associated with the steam reduces the viscosity of the oil in the oil bearing formation and the oil drains into a collection well.

In addition, in one embodiment, the SAGD oil recovery process disclosed herein utilizes substantially all of the feedwater directed to the boiler or the OTSG for oil recovery. That is, substantially all of the feedwater entering the OTSG or boiler is directed into the injection well, in the form of steam and water, for the purpose of heating the heavy oil in the oil bearing formation around the injection well.

Further, in one embodiment there is provided an oil recovery process that utilizes a boiler or steam generator to generate steam that is injected into an injection well. The steam produced by the boiler or steam generator is less than 100% quality steam, typically on the order of approximately 98% quality steam. Moreover, in this process the conventional boiler or steam generator blowdown stream is eliminated or substantially eliminated. The boiler or steam generator produces a steam stream that is typically 100% quality steam or slightly less than 100% quality steam. Further, the boiler or steam generator produces water (i.e., concentrated feedwater). Some of the water produced in the boiler or steam generator is recirculated back through the boiler or steam generator. Another portion of the water is mixed with the produced steam to form a steam-water mixture that typically is approximately 98% quality steam. The steam water mixture is injected into the injection well. Solids in the boiler or steam generator are removed via the water. That is, the solids in the boiler or steam generator become entrained in the water and along with the water are mixed with the steam and hence are ultimately injected into the injection well as a part of the steam-water mixture.

METHOD OF REMOVING HEAVY OIL

Figure 1:
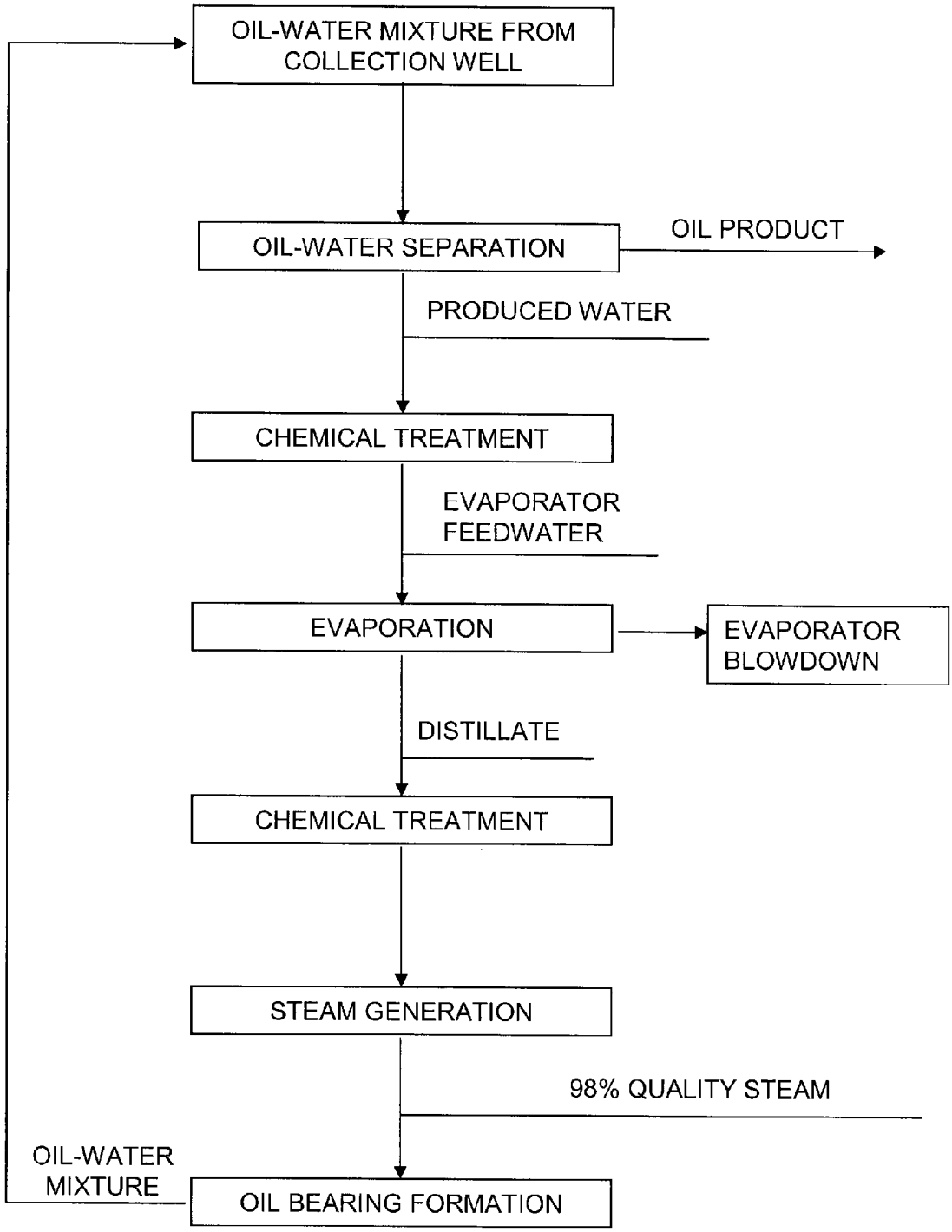
FIG. 1 is a flowchart illustrating basic steps in the present invention for a SAGD oil recovery process.

With further reference to the drawings, the present invention entails a SAGD process for recovering heavy oil, such as the oil found in the northern region of Canada. In implementing the SAGD process, steam, at least 98% quality, is injected into a horizontal injection well that extends through or adjacent to an oil bearing formation. The heat associated with the steam causes oil to drain into an underlying collection well. Because the steam condenses, the process results in an oil-water mixture being collected in the collection well and pumped to the surface. See FIG. 1.

The oil-water mixture is subjected to a separation process which effectively separates the oil from the water. This is commonly referred to as primary separation and can be carried out by various conventional processes such as gravity separation. Separated water is subjected, in some cases, to a de-oiling process where additional oil is removed from the water. Resulting water from the above oil-water separation process is referred to as produced water.

Produced water from the primary separation process includes dissolved inorganic ions, dissolved organic compounds, suspended inorganic and organic solids, and dissolved gases. Typically, the total suspended solids in the produced water are less than about 1000 ppm.

In some cases, after primary separation, it may be desirable to remove suspended inorganic and organic solids from the produced water. Various types of processes can be utilized to remove the suspended solids. For example, the produced water can be subjected to gas flotation processes or other processes that use centrifugal force, gravity separation, adsorbent or absorbent processes. After treating the produced water to remove suspended solids, typically the concentration of the suspended solids in the produced water is less than 50 ppm.

In addition to suspended solids, produced water from heavy oil recovery processes will include dissolved organic and inorganic solids in varying portions. As discussed below, the produced water will eventually be fed to an evaporator, and the evaporator will produce a distillate that will be directed to a steam generator or boiler. The dissolved organic or inorganic solids in the produced water have the potential to foul the evaporator and the steam generator or boiler. Depending on the absolute and relative concentration of these dissolved solids, the heavy oil recovery process of the present invention may employ chemical treatment of the feedwater after primary separation. Various types of chemical treatment can be employed. For example, scale inhibitors and/or dispersants can be added to the produced water to prevent inorganic fouling and scaling in the evaporator for hardness concentrations of approximately 150 ppm as $CaCO_3$ or less. In addition, silica scale inhibitors can be mixed with the produced water to prevent silica fouling and scaling in the evaporator. Moreover, the chemical treatment can include the addition of acid to partially convert alkalinity to $CO_2$ and thereafter the $CO_2$ can be removed by degassing. Finally, a caustic can be added to the feedwater to increase the pH to approximately 10. This will have the tendency to prevent organic and silica fouling in the evaporator system.

After the produced water has been chemically treated, the produced water is directed to an evaporator. The evaporator produces a distillate and an evaporator blowdown stream. Various types of evaporators can be used including but not limited to mechanical vapor compression and steam driven multiple effect. In addition, the heat transfer surfaces of the evaporator can be a plate-type or tubular-type and can be horizontal or vertical, with evaporation occurring on either side of these surfaces.

During the evaporation process, a portion of the produced water fed to the evaporator is vaporized. That portion of the produced water that is not vaporized is known as concentrate or brine. Substantially all of the solids in the produced water fed to the evaporator remain with the concentrate. The concentrate is discharged from the evaporator as a waste stream. This is commonly referred to as evaporator blowdown. The evaporator blowdown stream can be converted into a solid in a zero liquid discharge system (ZLD) or disposed in an injection well. Generally, the evaporator converts at least 90% of the produced water to vapor. Vapor is condensed in the evaporator where it releases its latent heat to vaporize produced water, or in a condenser where the heat sink is air or cooling water. After condensing, vapor becomes the distillate.

In some cases it may be desirable to treat or purify the vapor produced by the evaporator prior to the vapor being condensed into the distillate. This is because the vapor produced in the evaporator can contain entrained fine droplets of concentrate. The entrained droplets of concentrate contaminate the distillate. In some cases, chemical treatment of the distillate may be required in order to prevent scaling or fouling in the downstream steam generation system. By removing the entrained droplets in the vapor, the amount or degree of chemical treatment of the distillate may be reduced.

Figure 2:
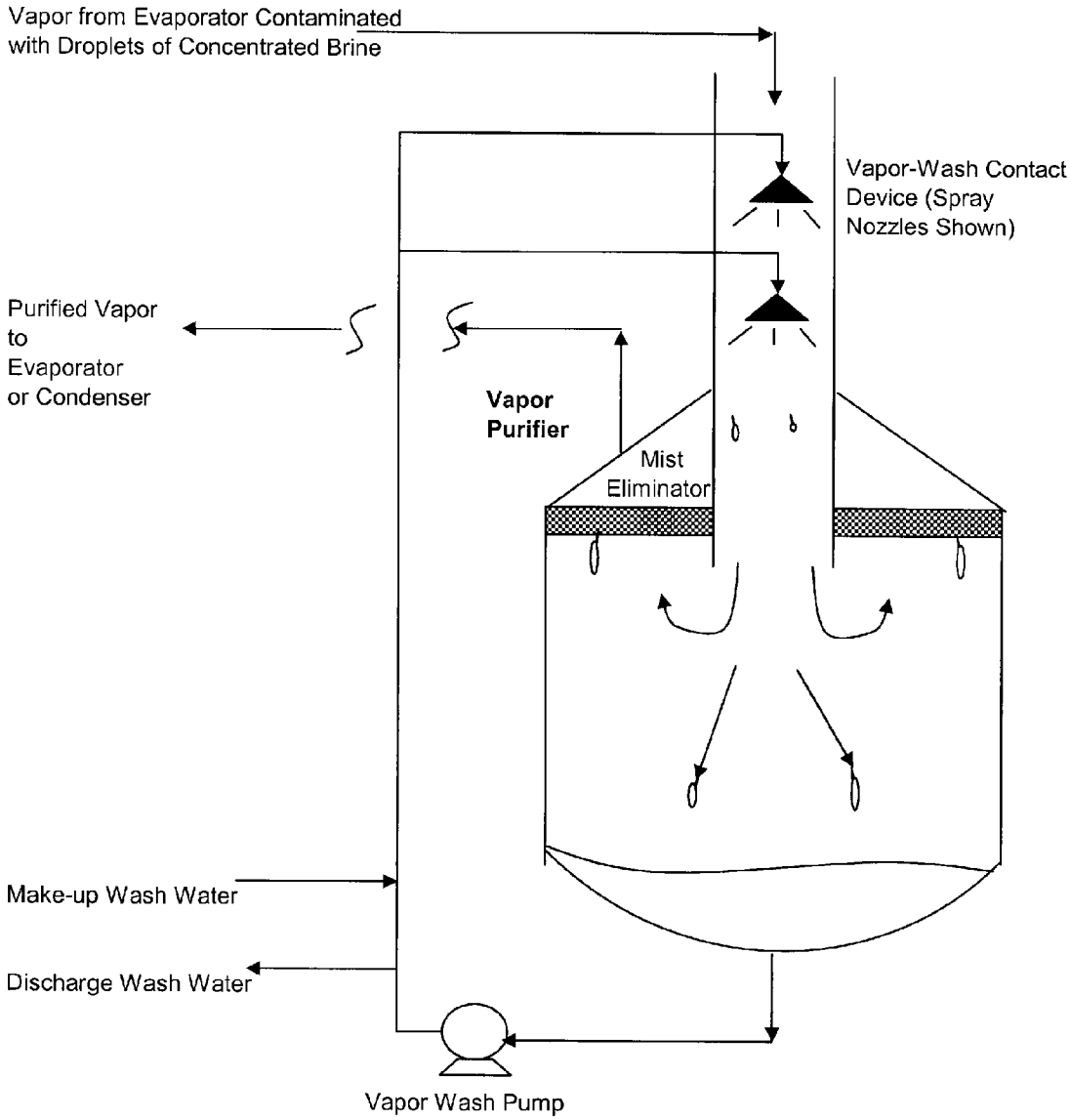
FIG. 2 is a schematic illustration of a vapor purifying process, which is one embodiment of the present invention.

FIG. 2 schematically illustrates a vapor purifier that can be associated with the evaporator for treating the vapor produced by the evaporator. As illustrated in FIG. 2, the vapor with entrained droplets from the evaporator enters the vapor purifier where it makes contact with wash water having a temperature substantially the same as the temperature of the vapor. Furthermore, the wash water includes a lower concentration of solids than the entrained droplets in the vapor being treated. Contact between the vapor and wash water can be achieved in various ways. For example, contact can be realized by utilizing one or more sprays, bubble trays or packing. Essentially the vapor is mixed with the wash water and the entrained droplets mix with and become a part of the wash water. Substantially all of the entrained concentrate droplets mix with the wash water and are removed from the vapor in the separation area of the vapor purifier. Since the solids concentration of the wash water increases due to the mixing of the entrained concentrate droplets, a portion of the wash water is discharged or recirculated back to the evaporator. This maintains a solids balance in the vapor purifier. The discharged wash water is replaced with fresh wash water, which is referred to as makeup wash water, and which has virtually no solids. This makeup water further dilutes the solids in the circulating wash water.

During the vapor purification process, it is possible for some droplets of the wash water to become entrained in the vapor. As seen in FIG. 2, the vapor after it has been washed is directed upwardly through a mist eliminator. As the vapor moves through the mist eliminator, substantially all of the entrained wash droplets are removed from the vapor and fall by gravity into the catch basin of the vapor purifier. The concentration of solids within the vapor entering the mist eliminator is substantially less than the original concentration of solids in the vapor entering the vapor purifier.

It is desirable to produce a high quality steam, for example at least 98% quality, and at the same time eliminate or substantially reduce blowdown streams from the steam generation system. To achieve this it may be desirable to treat the distillate produced by the evaporator and which forms the feedwater for the steam generation system to prevent corrosion, fouling or scaling in the steam generation system. Various forms of chemical treatment (phosphates, polymers, chelants, volatiles, and caustic) can be employed for these purposes.

The presence of oxygen in the distillate can be a source of corrosion. There are various processes that can be utilized to remove oxygen. For example, distillate from the evaporator can be directed to a deaerator before entering the steam generation system. Downstream of the deaerator, an oxygen scavenger of the type that will not contribute to scaling can be injected and mixed with the distillate. If the evaporator can be vented adequately, it may not be necessary to utilize a deaerator. Injecting an oxygen scavenger upstream of the steam generation system may be sufficient to reduce the concentration of oxygen in the distillate. Various oxygen scavenging chemicals can be utilized such as diethylhydroxylamine, commonly referred to as DEHA. As an alternate approach to removing oxygen from the feedwater to the steam generation system, an activated carbon filter can be utilized upstream of the evaporator to remove oxygen from the evaporator feedwater.

In a typical SAGD process, the distillate stream includes but is not limited to Ca, Mg, Na, K, $Fe^{+3}$, $Mn^{+2}$, $Ba^{+2}$, $Sr^{+2}$, $SO_4$, Cl, F, $NO_3$, $HCO_3$, $CO_3$, $PO_4$, $SiO_2$. A typical concentration for a number of the above elements is: Ca—0.0054 mg/l, Mg—0.0010 mg/l, Na—0.3606 mg/l, and K—0.0083 mg/l. Also, in a typical distillate stream, one would find suspended solids to be approximately 0.13 mg/l, TOC to be approximately 40 mg/l, non-volatile TOC to be approximately 5 mg/l, and hardness as mg/l , of $CaCO_3$—0.0176 mg/l. The pH of a typical distillate stream may be approximately 8.5.

The chemical treatment for hardness could include a polymer-phosphate blend or a chelant. This will solubilize hardness and prevent corrosion. A typical polymer-phosphate blend would comprise trisodium phosphate (TSP); sulfonated styrene/maleic acid (SSMA); high performance quad-sulfonated polymer; and phosphinocarboxylic acid (PCA). A caustic, such as NaOH, can be injected as required to adjust the pH of the distillate. The chemicals may be injected upstream of the boiler or directly into the boiler.

Table 1, below, illustrates some typical residual chemical constituents in the boiler water after chemical treatment. The degree and extent of chemical treatment may vary depending upon the operating pressure of the steam generation system.

In Table 1 the typical residual chemical constituents are shown for a boiler operating at 1200 psig, 1500 psig and 2000 psig.

TABLE 1

Typical Residual Chemical Constituents in Boiler Water for Varying Boiler Operating Pressures

| | Boiler Operating Pressure | | |
|---|---|---|---|
| Chemical | 1200 psig | 1500 psig | 2000 psig |
| Phosphate | 10-15 ppm | 8-12 ppm | 2-4 ppm |
| Polymer | 4-5 ppm | 2-4 ppm | 1-2 ppm |
| DEHA* | 20-40 ppb | 20-40 ppb | 20-40 ppb |
| Caustic | 0-2 ppm | 0-2 ppm | 0-2 ppm |

*DEHA is residual as measured in the boiler feedwater. All other chemicals are residuals measured in the boiler water, that is, the water recirculating through the boiler.

The chemistry of the distillate stream will vary, and accordingly, the chemical treatment suggested herein will also vary depending on distillate chemistry, the type of steam generation system utilized, operating pressures of the steam generation system, and the quality of steam produced, as well as other factors.

Figure 3:
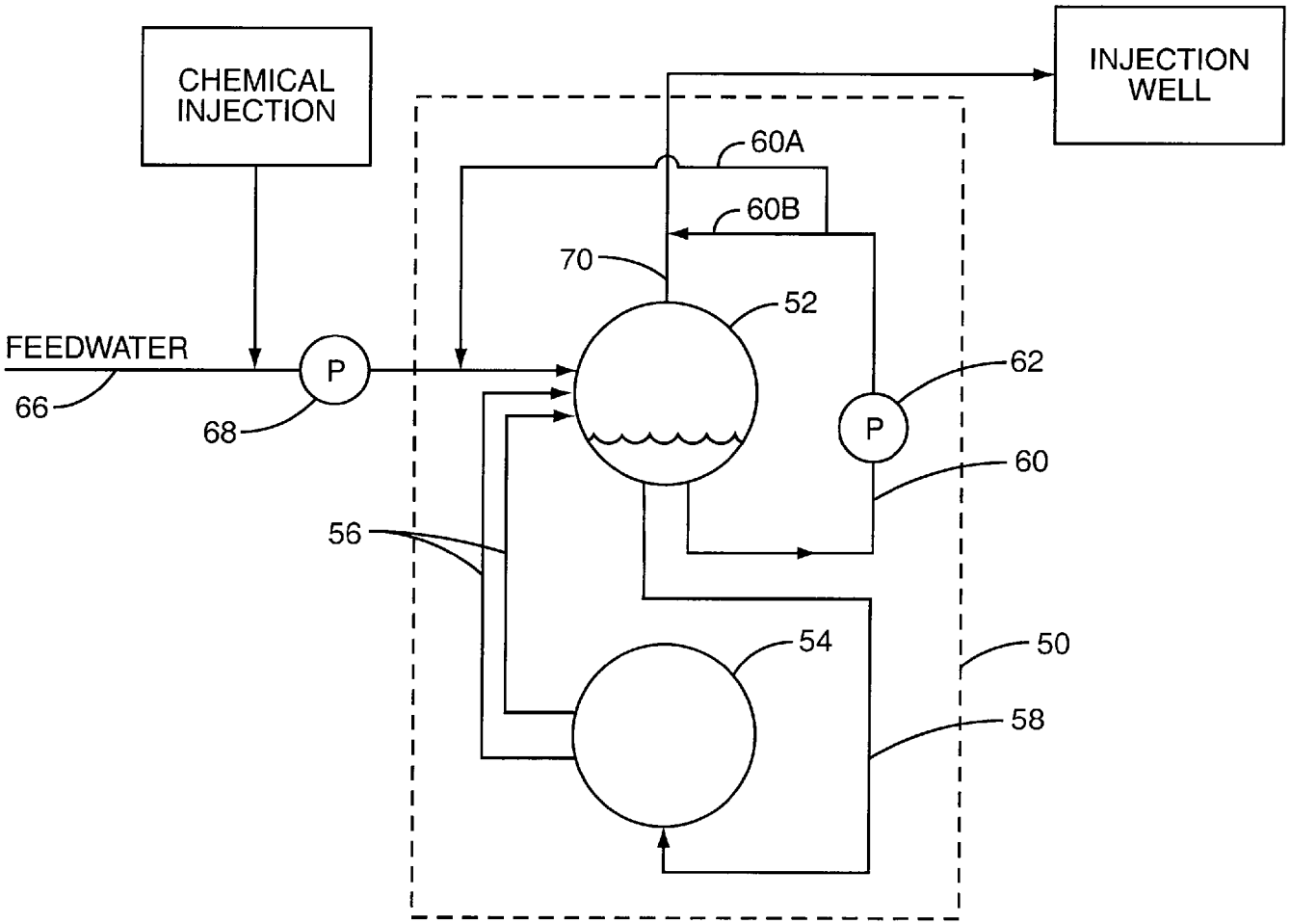
FIG. 3 is a schematic illustration of a boiler and the process of converting boiler feedwater to quality steam for injection into an injection well.

After treatment if a treatment process is implemented, the distillate is directed to a steam generation system. The steam generation system can assume various forms such as a boiler or a once through steam generator (OTSG). FIG. 3 illustrates a package boiler that is indicated by the numeral 50. Package boiler 50 includes a steam drum 52 and mud drum 54. A plurality of risers 56 extend between the mud drum 54 and the steam drum 52. A plurality of downcorners 58 extends between the steam drum 52 and the mud drum 54.

Boiler 50 is provided with a water recirculation loop 60. A pump 62 disposed in the recirculation loop 60 serves to pump the water from the steam drum 52 and back to the inlet of the steam drum 52 via line 60A. In addition, the recirculation loop 60 is connected, via line 60B, to a steam outlet line 70 that extends from the steam drum 52. This permits water moving in the recirculation loop 60 to be mixed with both the incoming distillate or feedwater and the steam in line 70 exiting the steam drum 52.

Water in the boiler 50 circulates naturally based on the differences in density between the water in the risers 56 and the downcorners 58. Downcorners 58 return water from the steam drum 52 to the mud drum 54. The temperature of the water in the downcorners 58 is at or slightly less than saturation temperature. The downcorners 58 are not used for heat transfer. Heat from combustion within the boiler 50 is applied to the outside of the risers 56. This heat is transferred to the water in risers 56 and results in partially boiling the water. The net effect is that the density of the column of fluid in the risers 56 is less than that of the fluid in the downcorners 58. This density differential drives the circulation of water from the steam drum 52 to the mud drum 54 and back to the steam drum. Steam is produced in the steam drum 52. Associated with the steam drum 52 of the boiler 50 is a conventional vapor-liquid separator that separates the steam or vapor from the water in the steam drum. Various mechanisms can be utilized in the boiler 50 to separate the vapor from the water. These separating mechanisms generally include gravity separators, centrifugal force separators, and mechanical entrainment elimination devices. Generally, nearly 100% quality steam is produced at the outlet of the steam drum 52.

As steam is produced in the steam drum 52, additional feedwater is directed through the boiler feedwater line 66 into the steam drum. The boiler feedwater will carry some nonvolatile solids. In this case, to deal with any significant solids introduced into the boiler 50, a portion of the water being recirculated in the recirculation loop 60 is directed into the steam outlet line 70. Here, the water mixes with the steam to form a steam-water mixture. Generally, it is contemplated that the water directed into the steam outlet line 70 will be such that the steam being directed into the oil bearing formation will be approximately 98% quality steam. Note that in this case, there is no boiler blowdown stream and approximately 100% of the heat transferred to the feedwater is injected for EOR. That is, on an ongoing basis, no waste stream is discharged from the boiler 50. This means that essentially all of the feedwater directed to the boiler 50 is utilized for oil recovery and injected into the injection well extending through the oil bearing formation.

Figure 4:
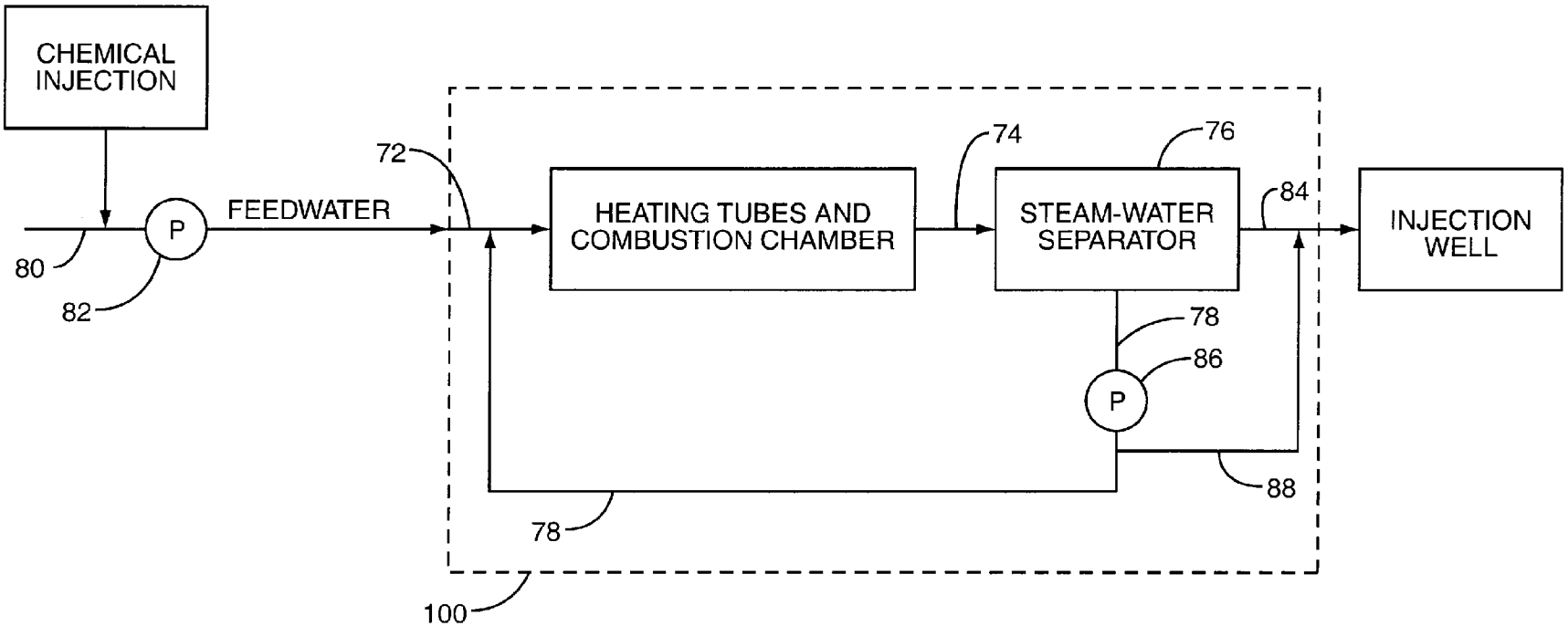
FIG. 4 is a schematic illustration of an OTSG and the process of converting OTSG feedwater to quality steam for injection into an injection well.

Another type of steam generator or steam generation system is shown in FIG. 4. In this case the steam generation system includes an OTSG 100. Note in FIG. 4 where there is provided a feedwater line 80 that leads to a pump 82. Extending between the pump 82 and the OTSG 100 is an inlet line 72. A steam outlet line 74 is communicatively connected with a steam-water separator 76. A recirculation loop 78 extends from the steam-water separator 76 to the inlet line 72. Disposed in the recirculation loop is a pump 86. A feed line 88 extends from the recirculation loop 78 and is communicatively connected to a steam outlet line 84 that extends from the separator 76.

OTSG 100 is a forced circulation type steam generator that utilizes the high pressure pump 82 to force the feedwater through heating tubes in the steam generator. Feedwater is pumped through the tubing and is heated from combustion heat applied exteriorly of the tubes. Water is partially converted to steam by the time the fluid exits the heat transfer tubing in the steam generator. Typically 70% to 80% of the water is converted to steam through this process. Water and vapor mixture exiting outlet line 74 is 70% to 80% quality steam. The 70% to 80% quality steam mixture enters the separator 76 where the steam is separated from the water. In the case of the present process, steam exits the separator 76 at approximately 98% quality or higher.

High pressure water from the separator 76 is circulated via recirculation loop 78 back to the inlet of the OTSG 100. As seen in FIG. 4, to control solids accumulation in the OTSG 100, a mixing stream of high pressure water is directed through mixing line 88 and combines with the steam being directed through the steam outlet line 84. Again, this produces a steam-water mixture having a steam quality of approximately 98%.

Figure 5:
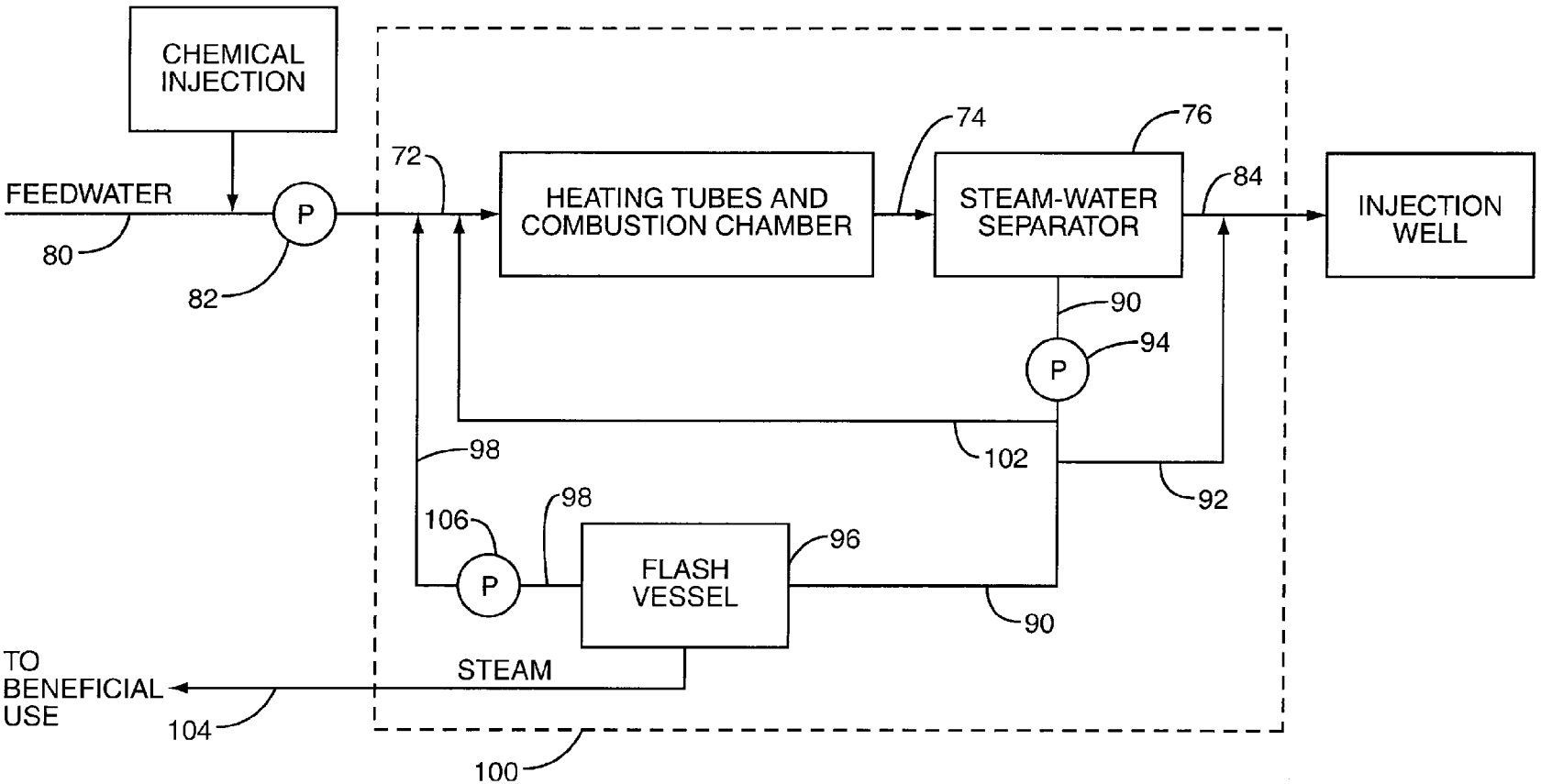
FIG. 5 is a schematic illustration of an alternate OTSG and an alternate process for converting OTSG feedwater to quality steam for injection into an injection well.

FIG. 5 illustrates an alternative steam generation system. In FIG. 5 there is a once through steam generator 100 that is similar in many respects to the system shown in FIG. 4 and described above. Line 90 extends from the steam-water separator 76 to a pump 94 which is operative to direct some of the water passing in line 90 to the steam outlet line 84 via feed line 92. Line 102 directs a portion of the water from line 90 to the feedwater inlet line 72. However, in the FIG. 5 embodiment, line 90 also connects to a flash vessel 96. Connected to the flash vessel 96 is a line 98, having pump 106 connected therein, which is operative to direct water from the flash vessel through line 98 to the feedwater inlet line 72. Flash vessel 96 also includes a vapor line 104 that is utilized to direct vapor from the flash vessel 96 to a beneficial use in the process where the heat associated with the vapor can be recovered.

Figure 6:
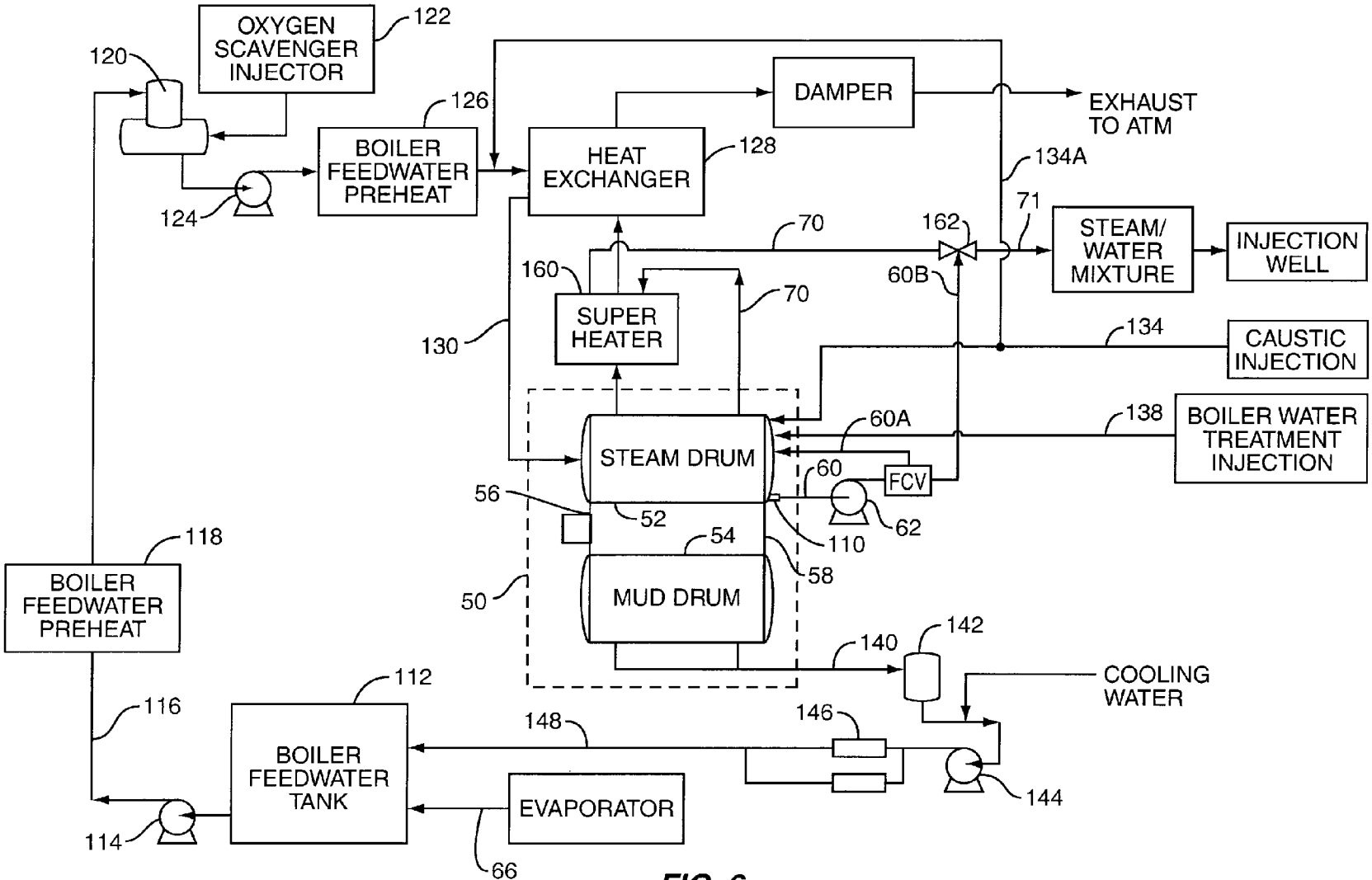
FIG. 6 is a schematic illustration showing an exemplary package boiler and how the package boiler is utilized to generate a steam-water mixture for injection into an injection well.

FIG. 6 shows a more detailed schematic of a package boiler design. The package boiler shown herein is similar to the package boiler shown in FIG. 3. As illustrated in FIG. 6, the package boiler 50 includes a steam drum 52 and a mud drum 54. A plurality of risers 56 extend between the steam drum 52 and the mud drum 54. In addition, a plurality of downcorners 58 extends between the steam drum 52 and the mud drum 54. Steam drum 52 includes a blowdown outlet 110 which ordinarily connects to a boiler blowdown line. As will be discussed subsequently herein, the blowdown outlet 110 is connected to line 60 which, as discussed above, branches into a recirculation stream or line 60A and a blending stream or line 60B. A discussion of line 60 and the process of mixing water and solids from line 60 into steam line 70 will be subsequently discussed.

Turning now to a description of the overall process, distillate from an evaporator is directed through line 66 into a boiler feedwater tank 112, which is disposed adjacent the boiler 50. Boiler feedwater in tank 112 is pumped by a transfer pump 114 into line 116 which extends thorough a boiler feedwater preheater 118. From the preheater 118, the boiler feedwater is directed into a deaerator 120. In conventional fashion, an oxygen scavenger injector 122 is communicatively coupled to the deaerator 120 for removing gases from the feedwater. From the deaerator 120, the feedwater is pumped by pump 124 through another preheater 126 and through a heat exchanger 128 on the inlet side of the steam drum 52. Feedwater passing from the heat exchanger 128 through line 130 is fed into the steam drum 52.

Boiler 50 produces steam. As seen in FIG. 6, steam from the steam drum 52 is directed through a super heater 160 which is heated by flue gases from the boiler 50. Steam leaving super heater 160 is directed through steam line 70 to a device referred to as a de-super heater 162. While temperature, pressure and other parameters can vary, in one embodiment the super heater 160 adds approximately 50° F. of super heat to the steam produced by the boiler. At a steam drum pressure of 1400 psig, the saturated temperature is approximately 587° F. Under these conditions, steam leaving the super heater 160 will have a temperature of approximately 637° F. (587° F.+50° F.).

Boiler 50 also produces a water stream that includes dissolved solids and which is directed out the steam drum 52 via the blowdown outlet 110 and line 60. Pump 62 pumps the water stream to a point where the water stream branches into streams 60A and 60B. Water and residual dissolved solids in stream 60B are mixed with the steam in primary steam line 70 in the de-super heater 162 to form a blended steam line 71 that is directed into an injection well. Water in line 60A is recycled to the steam drum 52.

Various chemicals are injected into the boiler 50 for treating the steam or water in the boiler. For example, as shown in FIG. 6 there is provided a caustic injection system 132 that injects a caustic via line 134 into the steam drum 52, or via line 134A into the boiler feedwater line 130. Likewise, another injection system 136 injects various boiler water treatments directly into steam drum 52 via line 138.

Boiler 50 includes a conventional mud blow off line 140 that is interconnected between the mud drum 54 and a blow off tank 142. The mud blow off collected in tank 142 is pumped by pump 144 to a filtering system 146. Filtering system 146 removes suspended solids from the mud blow off. The effluent from the filter system 146 is recycled through line 148 to the boiler feedwater tank 112. Occasionally cooling water can be injected into the line between the tank 142 and pump 144.

The mud blow off portion of the package boiler just described is conventional in packaged boilers. Typically one or more valves between the mud drum 54 and the mud blow off line 140 is open for a relatively short period of time. It is contemplated in one embodiment that these valves would be open once every eight hours for approximately 30 seconds. During this time, mud or sludge concentrated in the bottom of the mud tank 54 is forced under pressure through line 140 into blow off tank 142. This mud or sludge would include suspended solids, water, and dissolved solids.

In the embodiments shown in FIGS. 3-6, water is generally recirculated through the various recirculation loops and various branches extending therefrom. In the FIG. 3 embodiment, for example, water is circulated through line 60B to the steam outlet line 70, and from line 60 into branch line 60A into the feedwater inlet to the boiler. Preferably, flow of water into the various steam lines varies depending on the concentration of solids in the feedwater. The higher the concentration of solids in the feedwater, the greater the amount of recirculated water directed into the steam lines. However, in one embodiment, the amount of water recirculated and mixed with steam would not exceed 2% of the feedwater. To achieve a variable flow of recirculated water to the steam line, the process of the present invention could utilize various conventional means such as controlling the flow of water to the steam outlet line based on the sensed or measured concentration of solids in the feedwater.

As noted above, various types of controls can be employed to control and maintain the steam quality at approximately 98% or more. In the FIG. 6 embodiment, a flow control valve FCV is employed in line 60 and controls the amount of water recirculated through line 60A to the steam drum 52 and the amount of water directed through line 60B to steam line 70 for mixing with the steam. Basically in one example, the control scheme will first permit sufficient water to be mixed with the steam in line 70 to effectively de-super heat the steam. At this point, the steam is still approximately 100% quality steam. One control program, which uses the temperature difference between the super heated and saturated steam temperatures, would add a small excess amount of water into the de-super heater in line 70. For example, an additional 0.5% of the measured steam flow is added to the calculated de-super heating water flow and the resulting point is the set point for the flow control valve FCV. This will ensure 99.5% quality steam. At 100% design capacity, in one embodiment, steam is produced at 50° F. super heat from the boiler 50. As the boiler capacity is reduced, there will be less super heat in the steam, and less super heating water is required. When the amount of calculated super heating water decreases to 2% of the steam flow, the de-super heating flow control will remain at 2% of the steam flow rate to maintain 98% quality steam and for all operations below this point.

In cases where there is no super heater included with the boiler, the amount of water injected into the steam line is approximately 2% of the measured steam flow. This will permit 98% quality steam to be maintained.

The oil recovery processes, as discussed above, are designed to operate without a waste stream being generated and wasted from the steam generating systems shown in FIGS. 3-6. It is possible for upsets to occur in the overall oil recovery process, and for example, a significant amount of oil can be inadvertently passed into the boiler or steam generator feedwater, and hence into the boiler or steam generator. In such cases, it is beneficial to provide the steam generating system with some means of flushing and cleaning the boiler or steam generator to remove such oil or other contaminants. However, such flushing or cleaning forms no part of the ongoing steam generation process used in the oil recovery process. Rather, these measures are implemented for scheduled maintenance or to deal with an upset.

In the process embodiments discussed herein, it is desirable to inject substantially the entirety of the feedwater, in the form of steam and water, into the injection well. This means that the process can be carried out without any blowdown stream from either the boiler 50 or the OTSG 100. In the case of the process embodiments illustrated in FIGS. 4 and 5, the quality of the steam produced by the steam-water separator 76 may vary between 98% and approximately 100%. In the case of 98% quality steam, it is envisioned that there would be no need to inject water from the recirculation loops into the steam being directed into the injection wells. However, in cases where the steam-water separator 76 produces near 100% quality steam, it is envisioned that water from the recirculation loop would be injected into the steam being directed to the injection well in an amount that would yield a 98% quality steam. This would mean that sufficient water would be injected into the steam such that the water in the steam-water mixture injected into the injection well would constitute, by weight, approximately 2% of the fluid injected into the injection well.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

The invention claimed is:

1. A method of recovering oil from an oil well comprising:

a. recovering an oil-water mixture from the well;

b. separating oil from the oil-water mixture to produce an oil product and produced water;

c. directing the produced water to an evaporator and producing steam and a concentrated brine;

d. discharging at least some of the concentrated brine;

e. condensing the steam to form a distillate;

f. directing the distillate to a steam generator and heating the distillate in the steam generator to produce steam and water;

g. recirculating at least a portion of the water through the steam generator;

h. mixing at least a portion of the water produced by the steam generator with the produced steam to form a steam-water mixture; and i. injecting the steam-water mixture into an injection well.

2. The method of claim 1 wherein the steam generator produces a steam stream and a water stream, and the method includes recirculating a portion of the water stream through the steam generator and mixing another portion of the water stream with the steam stream to form the steam-water mixture.

3. The method of claim 2 including mixing the water with the steam and producing at least 98% quality steam, and injecting the at least 98% quality steam into the injection well.

4. The method of claim 2 including splitting the water stream into a recirculation stream and a mixing stream, recirculating the water in the recirculation stream through the steam generator; and mixing the water of the mixing stream with the steam in the steam stream to form the steam-water mixture.

5. The method of claim 4 wherein the water in the recirculation stream is mixed with the distillate feed water to the steam generator.

6. The method of claim 1 including directing the distillate to a once-through steam generator and into heating tubes thereof; heating the distillate in the heating tubes and producing a vapor-water mixture; directing the vapor-water mixture to a steam separator associated with the once through steam generator; separating water from the water-vapor mixture and producing the steam; recirculating a portion of the water back through the once through steam generator; and mixing another portion of the separated water with the steam to form the steam-water mixture.

7. The method of claim 6 wherein the vapor-water mixture produced by the once-through steam generator is approximately 70% to approximately 80% quality steam.

8. The method of claim 6 wherein the vapor-water mixture produced by the once-through steam generator is approximately 20% to approximately 40% quality steam.

9. The method of claim 1 including removing solids from the steam generator by entraining the solids in the water produced by the steam generator, and mixing a portion of the separated water having the entrained solids therein with the steam to form the steam-water mixture which includes solids from the steam generator; and injecting the steam-water mixture having the solids therein into the injection well.

10. The method of claim 9 including continuously or intermittently removing solids from the steam generator by mixing the water and solids therein with the steam such that substantially all of the solids are removed from the steam generator by injecting the solids in the steam-water mixture into the injection well and without utilizing a blowdown stream.

11. A method of recovering oil from an oil well comprising:

a. recovering an oil-water mixture from the well;

b. separating oil from the oil-water mixture to produce an oil product and produced water;

c. directing the produced water to an evaporator and producing steam and a concentrated brine;

d. discharging at least some of the concentrated brine;

e. condensing the steam to form a distillate;

f. directing the distillate to a boiler having a steam drum and a mud drum;

g. heating the distillate in the boiler and producing steam and water in the steam drum;

h. directing the steam from the steam drum;

i. removing solids from the boiler by entraining solids in the water within the steam drum and directing the water and solids from the steam drum;

j. recirculating a portion of the water with the solids back through the boiler;

k. mixing another portion of the water with the solids with the steam directed from the steam drum to form a steam-water mixture having solids therein; and l. injecting the steam-water mixture having the solids therein into an injection well.

12. The method of claim 11 including mixing the water with the steam to form the steam-water mixture having a steam quality of at least 98%.

13. The method of claim 11 wherein the distillate forms feedwater to the steam generator and wherein the amount of water mixed with the steam is maintained at 2% or less of the amount of feedwater directed into the steam generator.

14. A system for treating produced water from an oil recovery operation and producing a steam-water mixture for injection into an injection well, comprising:

a. an evaporator for receiving the produced water and producing a distillate;

b. a steam generator for receiving the distillate and producing steam and water, the steam generator including:

i. a steam line for directing the steam from the steam generator;

ii. a water recirculation line for receiving at least a portion of the water produced in the steam generator and circulating the water through the steam generator;

iii. a mixing line for receiving at least a portion of the water produced by the steam generator and directing the water to the steam line where the water is mixed with the steam in the steam line to form the steam-water mixture that is injected into the injection well; and iv. wherein by recirculating the water through the steam generator and mixing some of the water with the steam to form the steam-water mixture, solids are removed from the steam generator via the mixing line and the resulting steam-water mixture, thereby eliminating the need for a blowdown stream from the steam generator.

15. The system of claim 14 wherein the steam generator includes a boiler having a steam drum and a mud drum; and wherein the steam line extends from the steam drum; and wherein the water recirculation line leads from the steam drum and is operative to transfer water from the steam drum to an inlet of the steam drum; and wherein the mixing line is connected to the steam line and is operative to transfer water produced in the steam drum to the steam line where the water is mixed with the steam to form the steam-water mixture.

16. The system of claim 15 wherein the mixing line is connected to the recirculation line and extends between the recirculation line and the steam line so as to deliver water from the recirculation line to the steam line.

* * * * *